United States Patent [19]

Penninger et al.

[11] Patent Number: 4,752,406

[45] Date of Patent: Jun. 21, 1988

[54] 4-ALKYLBENZOYL ACRYLIC ACIDS AS CORROSION INHIBITORS IN OIL-BASED LUBRICANT SYSTEMS

[75] Inventors: Josef Penninger, Hilden; Karl-Heinz Schmid, Mettmann, both of Fed. Rep. of Germany

[73] Assignee: Henkekl Kommanditgesellschaft auf Aktien, Duesseldorf, Fed. Rep. of Germany

[21] Appl. No.: 708

[22] Filed: Jan. 6, 1987

[30] Foreign Application Priority Data

Jan. 9, 1986 [DE] Fed. Rep. of Germany ..... 3600401

[51] Int. Cl.[4] ..... C10M 129/26

[52] U.S. Cl. ..... 252/57; 252/56 R

[58] Field of Search ..... 252/57, 56 R

[56] References Cited

U.S. PATENT DOCUMENTS 3,556,994 1/1971 Diery et al. ..... 252/33.6

FOREIGN PATENT DOCUMENTS 2123858 12/1972 Fed. Rep. of Germany .
1149843 9/1981 Fed. Rep. of Germany .
3338953 9/1985 Fed. Rep. of Germany .
58-128339 8/1983 Japan .

OTHER PUBLICATIONS

*Ullmann's Encyklopaedie der Technischen Chemie,* vol. 18, 4th Edition (1979), pp. 1–2.

Winnacker, Kuechler, *Chemische Technologie,* vol. 4, *Organische Technologie II,* 3rd Edition (1972), p. 475.

*Indian Journal of Technology,* vol. 3, Mar. 1970, pp. 98–100.

*Primary Examiner*—William R. Dixon, Jr.
*Assistant Examiner*—Ellen McAvoy
*Attorney, Agent, or Firm*—Ernest G. Szoke; Henry E. Millson, Jr.; Mark A. Greenfield

[57] ABSTRACT

3-(4-alkylbenzoyl)-acrylic acids corresponding to formula (1)

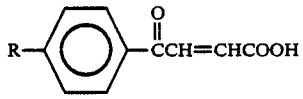

(I)

in which R is straight-chain or branched-chain $C_8$–$C_{18}$ alkyl, or mixtures thereof, are useful as corrosion inhibitors in lubricating oils and lubricating greases based on mineral oils.

12 Claims, No Drawings

4-ALKYLBENZOYL ACRYLIC ACIDS AS CORROSION INHIBITORS IN OIL-BASED LUBRICANT SYSTEMS

BACKGROUND OF THE INVENTION

1. Field of the Invention

This invention relates to the use of 3-(4-alkylbenzoyl)-acrylic acid as corrosion inhibitor in lubricating oils and lubricating greases based on mineral oils.

Industrial processes in which metal surfaces, particularly surfaces of iron and iron alloys, come into contact with oils or oil-containing aqueous emulsions under extreme temperature and pressure conditions are hampered by resultant corrosion of the metal surfaces. Processes of the type in question include, for example, industrial cooling processes, processes for cleaning metal surfaces, and processes for machining metal surfaces, such as drilling, cutting and rolling. Although oils or oil-containing emulsions are typically used in these processes, the effect of exposure to even the relatively small amounts of water usually present in these compositions presents corrosion problems. The built-up corrosion of the metal machine parts coming into contact with these oils or oil-containing liquids leads to a drastic reduction in the useful life of the machinery, and substantially precludes subsequent prophylactic treatment of the metal surface, such as application of a corrosion-inhibiting surface layer by phosphating or lacquering.

2. Statement of Related Art

Accordingly, it has long been known to add corrosion inhibitors to such oil-based liquids. Numerous compounds and mixtures of various compounds are known for use as corrosion inhibitors in predominantly oil-containing liquids or pure oils. For example, German published patent application No. 11 49 843 describes semiamides of saturated or unsaturated dicarboxylic acids and salts thereof with aliphatic primary amines as corrosion-inhibiting additives for fuel oils and lubricating oils. Although additives such as these distinctly improve the corrosion resistance of lubricating oils, they show a very marked tendency towards foaming which is unacceptable in additives of this type. Alkali or amine salts of sulfonamidocarboxylic acids for use as corrosion inhibitors which have a good lubricating effect with very little tendency towards foaming are described in German published patent application No. 12 98 672. However, corrosion-inhibiting preparations containing these compounds are disadvantageous insofar as elaborate processes are required for their production, and, because of their relatively high content of sulfonamide groups, they are least potentially toxic and occasionally exhibit toxic effects.

In addition, synthetic sulfonates developed from petroleum sufonates are known to inhibit corrosion in oil or oil-containing systems, cf. Ullmann's *Encyclopadie der techn. Chem.*, Vol. 18, 4th Edition (1979), pp. 1/2; Winnacker, Kuchler, *Chem, Technologie,* Vol. 4, Org. *Technologie II,* 3rd Edition (1972) p. 475. This class of compounds also has disadvantages, however, inasmuch as they are not biodegradable and, hence, cannot be used in processes which might impact on the environment through waste water or ground water contamination with resulting ecological damage.

DISCUSSION OF THE INVENTION

The invention accordingly provides a new class of corrosion inhibitors which obviate prior art disadvantages. Compounds according to the invention are at least equivalent to known corrosion inhibitors in their corrosion-inhibiting effect, and, in addition, have improved ecological and toxicological characteristics.

The corrosion inhibitors of the invention comprise acrylic acid derivatives [3-(4-alkylbenzoyl)-2-propenoic acids] corresponding to the following formula (I):

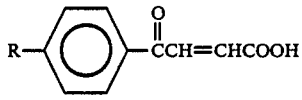

(I)

in which R is $C_8$–$C_{18}$ alkyl; and mixtures thereof; which function to decrease corrosibility of lubricating oils and lubricating greases based on mineral oils. The radical R broadly comprises unbranched or branched $C_8$–$C_{18}$ alkyl groups including octyl, nonyl, decyl, undecyl, dodecyl, tridecyl, tetradecyl, pentadecyl, hexadecyl, heptadecyl and octadecyl; straight-chain or branched alkyl groups containing from 8 to 12 carbon atoms, i.e., octyl, nonyl, decyl, undecyl and dodecyl groups are preferred.

The compounds in question are prepared by methods well-known in the art. Conveniently, alkylbenzenes corresponding to the following formula (II):

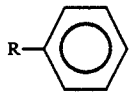

(II)

in which R is as defined above, are reacted with maleic acid anhydride in a Friedel-Crafts acylation to provide compounds of formula (I) in accordance with the invention. The products are directly obtained in high yields and in highly pure form.

In contrast to the 3-(4-alkylbenzoyl)-acrylic acids described in U.S. Ser. No. 661,535 filed Oct. 16, 1984 (based on German patent application DE-OS No. 33 38 953, published April, 1984), the present acrylic acid derivatives are effective in oil based systems as corrosion inhibitors, whereas compounds described in Ser. No. 661,535 which are compounds of the formula I wherein R is $C_1$–$C_6$-alkyl are primarily useful as corrosion inhibitors in aqueous systems.

The corrosion inhibitors of the invention are useful in oil-based lubricating systems which contain a minor amount of water, i.e., wherein the volumetric ratio of oil to water in the system is significantly greater than 1:1. Typically, the volumetric ratio of oil to water is greater than 5:1, and, more usually, greater than 10:1. Also included are oil-based lubricating systems that contain no measureable quantities of water. Lubricating systems within the scope of the invention are based on a variety of lubricating oils commonly employed in the art; lubricating oils and lubricating greases based upon mineral oil are particularly contemplated, especially oil-based dispersions and emulsions.

The present compounds are useful both individually and in admixture of two or more compounds as corrosion inhibitors in the oil-based systems of the invention. They are especially suitable for use in systems which contact steel surfaces, such as machinery. The corrosion inhibitors of the invention are soluble in mineral oil at room temperature, so that liquid concentrates may be prepared. The corrosion inhibitors of the invention are extremely effective in inhibiting corrosion even in low concentrations. Thus, it has surprisingly been found that quantities of only about 0.005 to 10% by weight are sufficient to afford excellent protection against corrosion. The preferred concentrations are from 0.01 to 1% by weight, based on the mineral oil present in the lubricating system.

The following Examples illustrate the practice of the invention.

EXAMPLES

EXAMPLE 1

Compounds corresponding to formula (I) were tested as corrosion inhibitors in mineral oil in accordance with DIN 51 359 (humidity chamber).

The test was carried out as follows:

Steel plates of 088 St-1405 grade, which were previously degreased and rubbed with emery cloth, were immersed in mineral oil samples (PIONIER 4556, a naphthene-based mineral oil which is a product of Hansen & Rosenthel, Hamburg) containing a compound corresponding to formula (I) as corrosion inhibitor. The steel plates were kept briefly in contact with the mineral oil/corrosion inhibitor sample, subsequently removed, and, after drying for 24 h, were suspended in the humidity chamber according to DIN 51 359 in which the relative air humidity was 100% for a constant supply of air of 875 l/h at a temperature of 50° C. After the prescribed test period, the steel plates were examined for corrosion.

The residence time in the humidity chamber and the sample concentration of the corrosion inhibitor in the mineral oil for each compound are shown in Table 1 below. Corrosion was evaluated on the following scale:

0: no corrosion
1: traces of corrosion
2: slight corrosion (corroded area ≦5%)
3: moderate corrosion (corroded area >5 and ≦20%)
4: serious corrosion (corroded area >20%).

TABLE 1

Corrosion according to DIN 51 359 (Example I) for compounds corresponding to the formula:

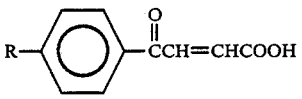

(I)

| R | Conc. (% by wt. of mineral oil) | Degree of Corrosion Test duration in days 2 | 10 | 15 | 20 |
|---|---|---|---|---|---|
| n-Octyl | 0.01 | 2 | 2 | 2 | 2 |
| | 0.05 | 0 | 1 | 1 | 1 |
| | 0.1 | 0 | 0 | 0 | 1 |
| | 0.5 | 0 | 0 | 0 | 0 |
| | 1.0 | 0 | 0 | 0 | 0 |
| n-Dodecyl | 0.005 | 0 | 1 | 1 | 1 |
| | 0.01 | 0 | 0 | 1 | 1 |
| | 0.05 | 0 | 0 | 0 | 1 |
| | 0.1 | 0 | 0 | 0 | 1 |
| | 0.5 | 0 | 0 | 0 | 0 |
| | 1.0 | 0 | 0 | 0 | 0 |
| No inhibitor* | — | 4 | 4 | 4 | 4 |

*Comparison Example 1

COMPARISON EXAMPLE 1

Following the procedure described in Example 1, steel sheets were immersed in identical mineral oil which did not contain a compound of formula (I) as corrosion inhibitor. Examination for signs of corrosion was carried out after the same treatment and on the same evaluation scale as in Example 1. The results are shown in Table 1 above.

Result:

Whereas the steel sheets immersed in mineral oil containing a compound corresponding to formula (I) showed no corrosion or at most very slight corrosion (degree of corrosion up to 2), sheets which had been immersed in mineral oil containing no corrosion inhibitor all showed serious corrosion. Serious corrosion was observed after only a short test period.

EXAMPLE 2

Steel bars of CK 15 grade, which had been previously degreased and emeried, were subjected to a mineral oil/water stirring test according to DIN 51 585. To this end, the bars were immersed for 24 h at 60° C. in a stirred mixture of mineral oil of the same quality as in Example 1 and water (method A) or of mineral oil of the same quality as in Example 1 and artificial seawater (method B); the mineral oil-water mixture was stirred at a speed of 1000 r.p.m. The ratio by volume of oil to water in each method was 10:1. After 24 h, the bars were removed from the mineral oil-water mixture and examined for signs of corrosion.

The concentration of each of the test compounds used as corrosion inhibitor in the mineral oil for each of the Methods A and B is shown in Table 2 below. Evaluation was carried out on the same scale as used in Example 1.

TABLE 2

Corrosion according to DIN 51 585 using compounds corresponding to the following formula:

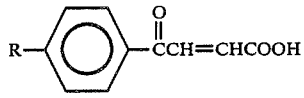

(I)

| R | Method | Degree of Corrosion Conc. (% by wt. of mineral oil) 0.01 | 0.05 | 0.1 | 0.5 |
|---|---|---|---|---|---|
| n-Dodecyl | A | 1 | 0 | 0 | 0 |
| | B | 4 | 3 | 3 | 0 |
| n-Octyl | A | 0 | 0 | 0 | 0 |
| | B | 4 | 4 | 3 | 0 |
| No inhibitor* | A | | | 4 | |
| | B | | | 4 | |

*Comparison Example 2

COMPARISON EXAMPLE 2

Following the same procedure as in Example 2, steel bars were immersed in mineral oil which did not contain a corrosion inhibitor corresponding to formula (I). The corrosion test was carried out both with a mixture of mineral oil of the same quality as in Example 1 and water (method A) and with a mixture of mineral oil of the same quality as in Example 1 and artificial seawater (method B). The results are shown in Table 2 above.

Result:

In the corrosion test according to DIN 51 585, the compounds corresponding to formula (I) afford satisfactory to good protection against corrosion in mineral oil, particularly in concentrations above 0.05% by weight, based on mineral oil. By contrast, identical steel bars were heavily corroded by mineral oil-water mixtures which did not contain a corrosion inhibitor.

We claim:

1. A method for reducing the corrosiveness of oil-based lubricating systems comprising incorporating a corrosion-reducing quantity of at least one compound of the formula

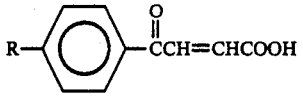

in which R is straight-chain or branched-chain $C_8$–$C_{18}$ alkyl, into said system.

2. The method of claim 1 wherein the oil-based system is a mineral-oil based system comprising a lubricating oil or lubricating grease.

3. The method of claim 1, wherein R is straight-chain or branched-chain $C_8$–$C_{12}$ alkyl.

4. The method of claim 2, wherein the compound is employed in a corrosion-inhibiting amount of from about 0.005 to 10% by weight, based on the mineral oil present.

5. The method of claim 4, wherein the corrosion-inhibiting amount of the compound is from about 0.01 to 1% by weight.

6. The method of claim 1, wherein R is n-octyl or n-dodecyl.

7. A composition consisting essentially of an oil based lubricant and a corrosion inhibiting quantity of at least one compound of the formula

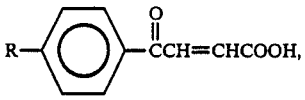

wherein R is $C_8$–$C_{18}$-alkyl.

8. The composition of claim 7, wherein R is $C_8$–$C_{12}$-alkyl.

9. The composition of claim 7 wherein the oil based lubricant is a mineral oil based lubricant.

10. The composition of claim 9, wherein the corrosion-inhibiting compound is present in an amount of from about 0.005 to 10% by weight based on the mineral oil present.

11. The composition of claim 10, wherein the corrosion-inhibiting compound is present in an amount of from about 0.01 to 1% by weight.

12. The composition of claim 10, wherein R is n-octyl or n-dodecyl.

* * * * *